United States Patent [19]

Rebold

[11] 4,171,097

[45] Oct. 16, 1979

[54] AIRBRUSH

[75] Inventor: Jerome I. Rebold, Timonium, Md.

[73] Assignee: CBS Inc., New York, N.Y.

[21] Appl. No.: 904,846

[22] Filed: May 11, 1978

[51] Int. Cl.[2] ..... B05B 7/30

[52] U.S. Cl. ..... 239/341; 239/346; 239/375; 239/417.3; 239/458

[58] Field of Search ..... 239/341, 345, 346, 371, 239/375, 416.5, 417, 417.3, 451, 456–459, 460, 530

[56] References Cited

U.S. PATENT DOCUMENTS

| | | | |
|---|---|---|---|
| 923,910 | 6/1909 | Thompson | 239/341 |
| 1,272,752 | 7/1918 | Wold | 239/345 |
| 1,703,359 | 2/1929 | Paasche | 239/346 X |
| 4,102,500 | 7/1978 | Luff | 239/417.3 X |

*Primary Examiner*—Robert W. Saifer

*Attorney, Agent, or Firm*—Spencer E. Olson

[57] ABSTRACT

The disclosed airbrush has an elongated body formed in one piece, as by a molding from plastics material, having an internal cylindrical bore defining a cavity in which other elements are contained. A carrier member assembled within and sealed for a portion of its length to the cylindrical bore supports the point of a needle at a predetermined distance from the forward end of the body and has an internal passageway for the paint. The cylindrical bore is closed at its forward end by a cap threadably attached to the body, inside which is threadably secured a jet through which the point of the needle extends. The carrier member is shaped to provide, in association with the internal bore of the body, a passage for air to the cap and jet region of the airbrush. Adjustment of the longitudinal position of the cap on the body moves the jet with respect to the stationary needle to provide regulation of the amount of paint flow.

9 Claims, 4 Drawing Figures

Fig. 1
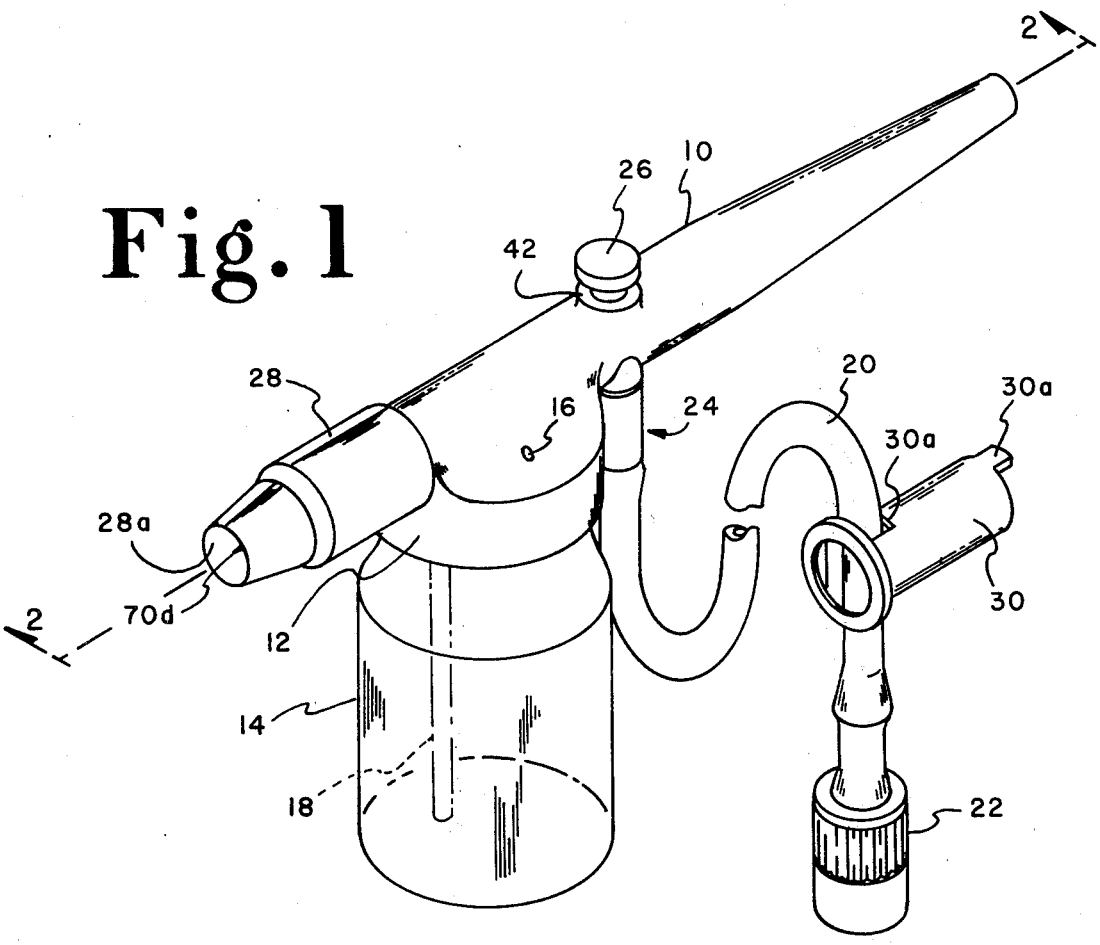
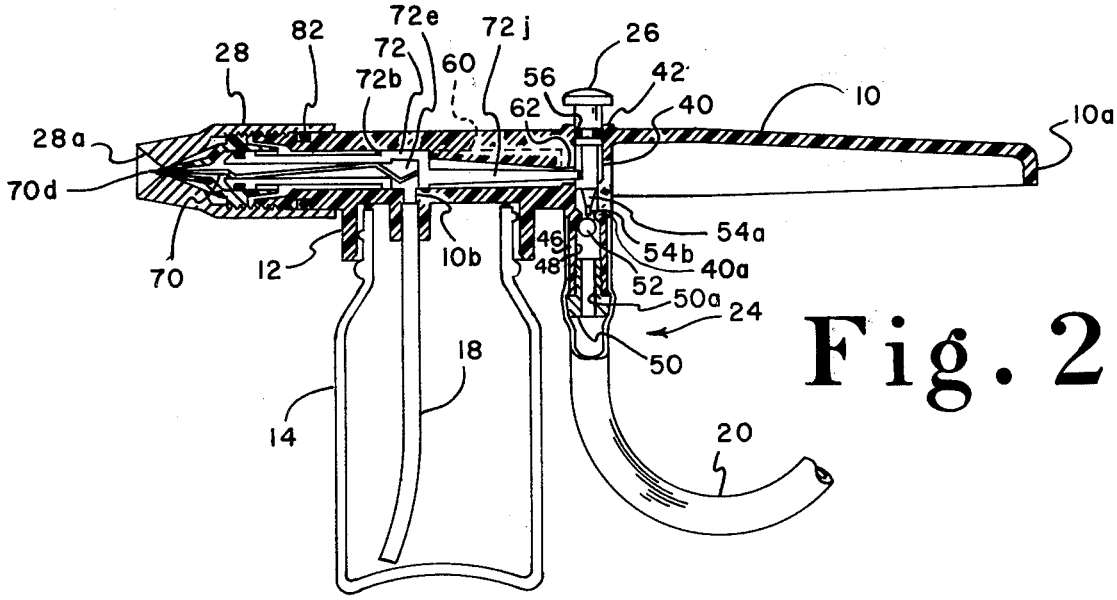
Fig. 2

AIRBRUSH

BACKGROUND OF THE INVENTION

The present invention relates to airbrushes, and more particularly, to an improved airbrush of relatively small size of the type used by hobbyists and craftsmen for painting relatively large areas.

Airbrushes have long been used by artists, photographers, designers, illustrators and others for fine or delicate work. Over a long period of development, two general types of airbrushes have emerged, those having a single control lever for controlling the entry of air or other aeriform substance and the amount of paint flow, and the other having only a control for entry of air with no provision for adjusting the flow of paint during operation. A variety of both types are commercially available, the former being relatively more expensive and used for fine or delicate work, and the other type, because of the lack of control of paint flow, normally being used for less delicate work, such as the painting of models, touch-up work, and work on relatively large areas not requiring fine control of the paint spray. Indeed, some of the less expensive commercially available airbrushes of the latter type are hardly more than an atomizer in that air is blown over a dip tube to draw the paint from a receptacle and force it through a preset nozzle.

The present invention is directed to airbrushes of the less expensive type, the object being to provide an airbrush that can be sold at a price competitive with airbrushes in the low price category yet have a performance approaching that of more expensive airbrushes. A more specific object of the invention is to provide an airbrush having a minimum number of parts that can be manufactured and assembled at low cost, and which can be readily disassembled for cleaning of the jet and needle.

SUMMARY OF THE INVENTION

Briefly, the airbrush according to the invention has an elongated generally cylindrical body formed in one piece, as by molding from a suitable plastics material, and having a cylindrical internal bore for a portion of its length defining a cavity in which other elements are contained. In particular, a carrier member assembled within the cylindrical bore supports a needle that extends a predetermined distance from the open end of the bore and also defines a passageway for the paint. The bore is closed at its forward end by a cap inside which is threadably secured a jet, preferably molded from a suitable plastic material, through which the free end of the needle extends. By adjusting the longitudinal position of the cap on the body the jet is also moved with respect to the stationary needle, thereby providing regulation of the amount of paint through the jet. The body includes an integrally molded cap for receiving a threaded paint jar from which paint is delivered to the paint passageway by a dip tube. The carrier member is shaped to provide, in association with the cylindrical bore, a passage for air to the region of the jet.

BRIEF DESCRIPTION OF THE DRAWINGS

Other objects, features and advantages of the invention will become apparent, and its construction and operation better understood, from the following detailed description, taken in conjunction with the accompanying drawings, in which:

FIG. 1 is a perspective view of the airbrush according to the invention;

FIG. 2 is an elevation cross-sectional view taken along line 2—2 of FIG. 1;

DESCRIPTION OF THE PREFERRED EMBODIMENT

Figures 3, 4:
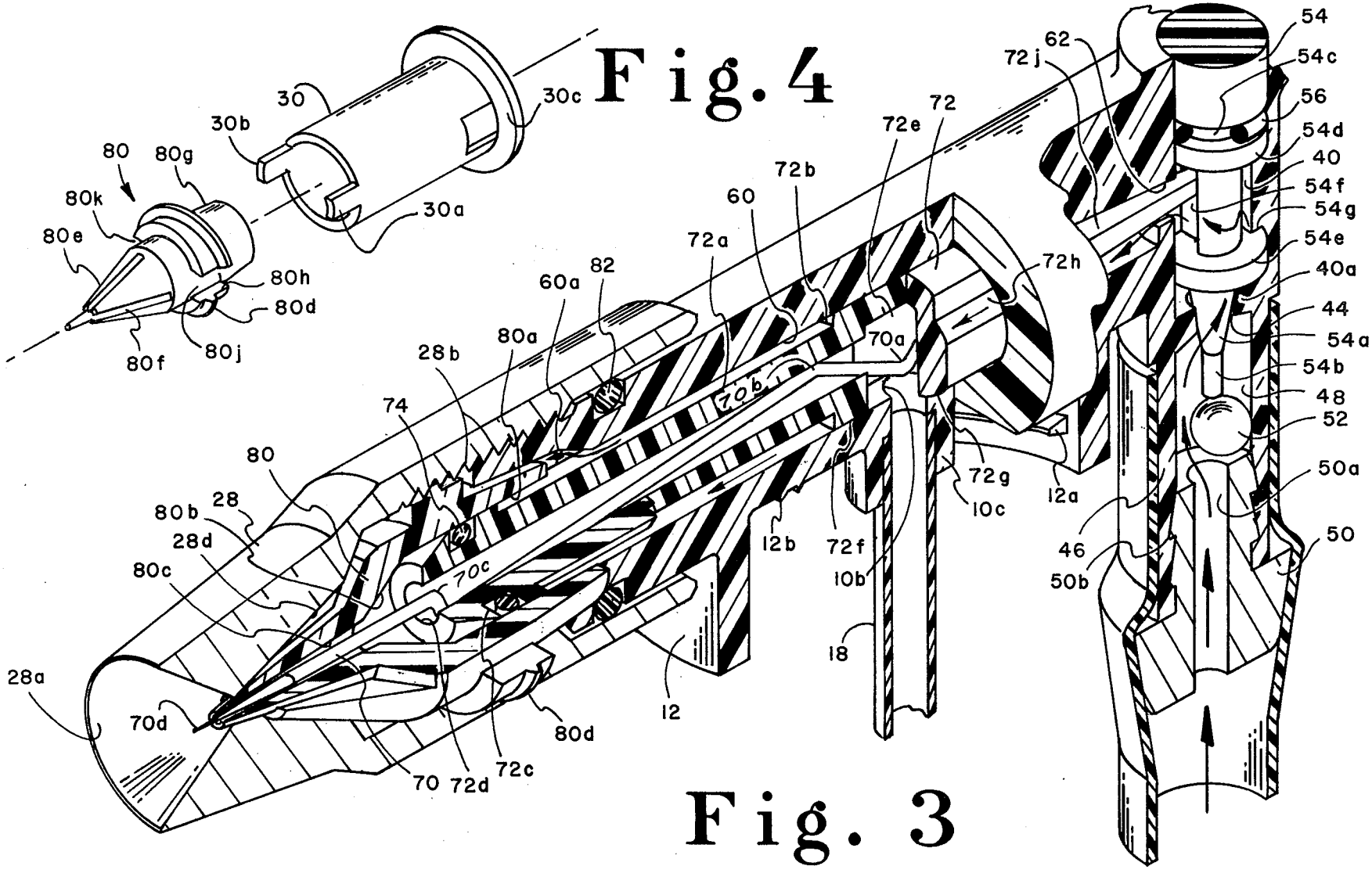
FIG. 3 is a greatly enlarged perspective view, partly cut away, of the left-hand portion of the airbrush, as viewed in FIG. 1.
FIG. 4 is an enlarged perspective view of the jet element of the airbrush and a wrench provided for removal of the jet from the cap.

Referring to FIG. 1, the airbrush according to the invention, shown essentially full size, includes an elongated body 10 which when viewed from the top and sides appears to be cylindrical, and which is gradually tapered toward the rear end. Body 10 preferably is molded from a suitable plastics material, such as Delrin, and includes as an integral part a depending internally threaded cap 12 dimensioned to receive a standard size, commercially available glass jar 14 for containing the paint. The cover has an opening 16 formed therein communicating the interior of the jar to the atmosphere, and paint is drawn by aspiration into the body of the airbrush through a dip tube 18. Air or other aeriform substance under pressure is applied to the airbrush through a hose 20 to one end of which is secured a standard fitting 22 and the other end of which engages a connector and valve assembly 24, the barrel of which is integrally molded with the body 10. The contained valve mechanism (to be described) is actuated by a finger-operated push button 26 which extends upwardly from body 10 at a position approximately equidistant from its ends. The body 10, which, as will be seen, has an internal bore extending from just forward of button 26 to its forward end, is closed at its forward end by an internally threaded cap 28, preferably formed of metal, which engages threads molded on the front end portion of the body. The front end of cap 28 is flared at **28*a* and is provided with a small orifice from which paint emerges under control of a jet threadably and removably secured within cap 28, and a needle, the construction and action of which will be described shortly. A wrench 30 for removing the jet from cap 28 for cleaning or replacement, the construction of which will be described in more detail later, is provided with an opening 30*a* so that it can be placed over hose 20** to preclude its loss or misplacement so as to always be conveniently available for use when needed.

It will be seen in FIG. 2 that the underside of that portion of body 10 that extends rearwardly from button 26 and valve assembly 24 is hollow and closed at **10*a*. This construction serves to reduce the weight of the device with an attendant reduction in the cost of the molding material required for fabrication of the body. Immediately forward of the hollow portion body 10 has a vertically oriented bore 40 formed therein, the upper end of which is surrounded by a boss 42. The bore 40 is of uniform diameter throughout its length and at its lower end is partially closed by a circumferential shoulder 40*a* which has a tapered central opening 44. Below the shoulder is formed a second colinear bore 48 enclosed by a short hollow tube 46. A barb member 50, preferably formed of metal, such as aluminum, and having an axial internal passage 50*a*** and having barbs 50*b* on its external surface, is received by and firmly held in bore 48 and serves as a retainer for a small ball 52, and also facilitates the attachment of hose 20 to tube 46. In the non-operated condition of the airbrush, illustrated in FIG. 2, air under pressure within hose 20 forces ball 52 upwardly against the underside of shoulder 40*a* thereby to close opening 44 and prevent air from entering the airbrush. The valve is opened by a valve stem 54 integrally molded with button 26 from a suitable plastic material, such as Delrin, which has a tapered section 54*a* near its lower end dimensioned to be received in tapered opening 44 and terminating in a reduced diameter stem 54*b*. As best seen in the enlarged illustration of FIG. 3, where the valve is shown in its operated position, the diameter of the upper portion of the valve stem is slightly smaller than the diameter of bore 40, and at a position thereon to be contained within bore 40 at both the operated and non-operated positions of the valve has a circumferential groove 54*c* for retaining an "O-ring" 56, which provides an air seal between stem 54 and bore 40. From a point 54*d* immediately below the "O-ring" to a point 54*e* the stem is of reduced diameter and has a longitudinally extending slot 54*f* formed in its outer surface, the purpose for which will shortly become evident. Between point 54*e* and the tapered portion 54*a* the diameter of the stem is again substantially equal to the diameter of bore 40. This short section has a pair of diametrically opposite, axially extending slots formed therein, one of which is visible at 54*g* in FIG. 3, which provide passages for air to enter the region surrounding the reduced diameter portion when the valve is open.

From a point immediately forward of the valve assembly, body 10 has an internal cylindrical bore 60 of uniform diameter throughout a major portion of the remaining length of the body, the diameter increasing at point 60*a* with a slight flare to the front end of the body. The interior end of bore 60 communicates, through an opening 62, with the volume surrounding the reduced diameter portion of valve stem 54 to provide an entry for air into bore 60.

Separated passageways for air and paint, and fixed support for a needle 70, is provided by a carrier member 72 contained within bore 60. Carrier member 72 is a unitary molded plastic part, formed of Delrin for example, having an overall length somewhat greater than the length of bore 60. The front end of the carrier has a cylindrical portion 72*a* which, except for a small portion at the forward end, has a uniform outside diameter somewhat smaller than the diameter of bore 60 to a point 72*b*. A short portion at the front end has a slightly larger outer diameter and has a circumferential slot 72*c* formed therein for receiving and retaining an "O-ring" 74, the function of which will subsequently be described. The cylindrical portion 72*a* has a circular cross-section bore 72*d* extending rearwardly from the front end and terminating in a hollow compartment 72*e* of generally cubical shape, one face of which is open and confronts an opening 10*b* in the wall of body 10; the opening is surrounded by a cylindrical boss 10*c* having an opening dimensioned to receive the dip tube 18 with a snug fit. That portion of the carrier in which compartment 72*e* is formed is of generally inverted "U"-shape in cross-section, as best seen in FIG. 3, and is dimensioned to be received with a press fit in bore 60 to provide a paint-to-air seal at points 72*f* and 72*g* between the lower ends of the "U" and bore 60, around opening 10*c*. Thus, paint drawn up the dip tube by aspiration (to be described) enters compartment 72*e* and passes through and exits from the forward open end of bore 72*d*. The exterior surface of the "U"-shaped portion is curved to conform to bore 60 and is in sealing engagement therewith, and the exterior surface of the "legs" of the "U" each have an axial cutout, one of which is visible at 72*h* in FIG. 3, which cooperate with bore 60 to define passages through which air can pass from the rear portion of bore 60 into the annular passageway defined by cylindrical portion 72*a* of the carrier and bore 60. Integral with the "U"-shaped portion and extending rearwardly therefrom substantially along the axis of bore 60 is a slightly tapered tang 72*j* of generally rectangular cross-section, which extends through opening 62 with its rearmost end received in slot 54*f* in the valve stem. Thus, the tang 72*j* retains the valve stem in bore 40 and determines its rotational position therein. Carrier 72 is inserted into bore 60 from the forward end, preferably when cold but with the body 10 still hot from the molding process, such that upon cooling of body 10 the "U"-shaped portion of the carrier and the bore are jammed together with heavy interference to ensure a tight seal.

A needle 70, which may be formed of 0.020 inch diameter stainless steel spring wire, is removably supported within bore 72*d*. It is retained in the bore by shaping the wire by crimping it at three places: at 70*a* and 70*b* at such angles that when the rearmost end is received in compartment 72*e*, bend 70*a* drops into opening 10*b*, bend 70*b* engages the upper surface of bore 72*d* and the section between bends 70*a* and 70*b* engage a point on the circumference of the open rear end of bore 72*d*; and with a flattened "S" curve at 70*c* such that the wire engages the lower surface of bore 72*d* near its forward end and positions the free end of the needle substantially on the longitudinal axis of bore 72*d*. The forward end of the needle is tapered at 70*d* to a sharp point, the length of the taper being of the order of 0.08 inch. The wire is sufficiently flexible as to be insertable after carrier 70 is in place, and to be removable for replacement, if necessary. It will be evident that the described construction locates the tip of needle 70 at a predetermined distance from the forward open end of bore 60.

The tip of needle 70 extends into a jet 80, preferably molded from a suitable plastics material, such as Delrin, having a cylindrical bore 80*a* for a portion of its back-to-front length, which tapers down at 80*b* into a small tapered opening 80*c* having a diameter at its forward end slightly less than the diameter of the needle wire, so as to be closed when the tapered portion 70*d* of the needle is jammed into the jet. The bore 80*a* has a diameter and is of a depth to receive the front end of portion 72*a* of the carrier, the O-ring 74 providing an air seal between the forward end of carrier 72 and the interior of jet 80.

The jet has a one-turn thread 80*d* formed on its external surface which engages internal threads 28*b* in cap 28, whereby the jet is removably secured in the cap with its forward end lying essentially in the plane of opening in the cap. As best seen in FIG. 4, the external surface of the jet is tapered forwardly at 80*e*, this tapered portion having four circumferentially distributed, axially extending slots, one of which is visible at 80*f* which serve as passages for air to flow forwardly toward the tip of the jet, which passages are further defined by a similarly tapered bore 28*d* internally of the forward end of the cap. The outer diameter of the jet tapers rearwardly at 80*g* from thread 80*d* and with the flared outer end of bore 60 in body 10 defines an annular passageway for air up to the thread 80*d*. A pair of diametrically opposed axial cutouts 80*j* and 80*k* extending through the thread serve as passageways for air to flow from the annular passageway into the tapered jet-cap region. Cap 28 is threadedly secured to threads formed, during molding, on the forward end of body 10 and extends rearwardly beyond an "O-ring" 82 retained in an external circumferential groove in body 10 to provide an air seal between the atmosphere and air under pressure within the cap.

From the description thus far it will be seen that when the air valve is opened by depression of stem 54, air from the source passes through slot 54*g*, through opening 62 into the rear portion of bore 60 through cutout 72*h* in the outer surface of the "U"-shaped member, into the annular passage defined by bore 60 and the external surface of portion 72*a* of the carrier, into the annular passageway defined by the tapered rear cylindrical portion of jet 80 and the tapered forward end of bore 60, through axial cutouts 80*h* and 80*k*, in the jet and finally through the grooves 80*f* formed in the tapered outer surface of jet 80 and exits through the opening in cap 28. The described air flow causes a vacuum at the forward tip end of the jet, causing paint to be drawn from jar 14 through dip tube 18 and opening 10*b* into compartment 72*e* and into bore 72*d* in the cylindrical front portion of the carrier and thence into the tapered annular passageway defined by the internal tapered bore 80*c* of the jet and needle 70. By virtue of the jet being secured to and movable with cap 28, and needle 70 being fixedly secured to body 10, the amount of paint flow is determined by the longitudinal position of cap 28 on body 10; thus a desired flow can be preset, or adjusted during operation of the airbrush, by rotating cap 28 relative to the body to change the degree to which the tapered portion 70*d* of the needle penetrates the orifice in the forward end of the jet.

To facilitate removal of jet 80 from cap 28 for cleaning and/or replacement, the previously mentioned wrench 30 is provided, the construction of which will be apparent from FIGS. 1 and 4. It consists essentially of a hollow tube having an outer diameter slightly smaller than the inside diameter of cap 28 and an inner diameter slightly larger than the tapered rear portion 80*g* of jet 80, and is formed with a pair of diametrically opposed axially extending ears 30*a* and 30*b* dimensioned to be received by the axial slots in the jet, and with a ring 30*c* at the other end. With the wrench attached to hose 20, as shown in FIG. 1, the wrench is simply inserted into the open end of the cap, and the cap turned relative to the wrench until the single thread 80*b* on the jet is free of the threads in the cap.

As best seen in FIG. 3, the paint jar cap 12, which is integrally molded with the body 10, has a single thread 12*a* molded therein of a pitch and size to engage the threads of a standard jar, and the top surface is formed with a pair of closely spaced circular ribs of a diameter and so oriented as to be engaged by the lip of the jar when in place in the cap, these ribs improving the seal between the jar and its cap.

It will be evident from the foregoing description that there is provided an airbrush having a minimum number of relatively inexpensive parts that are easily assembled, and which when assembled automatically preset certain dimensional inter-relationships, while at the same time providing adjustment of paint flow by simple adjustment of the longitudinal position of cap 28 on body 10. Also, by adjustment of cap 28 the jet may be completely closed to minimize drying of paint in the nozzle region, and when cleaning is required, cap 28 is easily removable from the body, the jet is easily removable from the cap, and the needle can be readily removed from the carrier for thorough cleaning and/or replacement.

I claim:

1. An airbrush comprising:

a unitary elongated body having a generally cylindrical forward portion having an axial bore therein and an internally threaded cap depending therefrom for receiving a paint jar, a rearward portion extending rearwardly from said cylindrical forward portion, and a tubular portion depending from approximately the junction of said forward and rearward portions, an internally tapered air cap threadably removably secured to the forward end of the cylindrical forward portion of said body and adapted for longitudinal adjustment forwardly from a rearwardmost position, an externally tapered jet detachably secured within said air cap, said jet having an axial opening therethrough tapered toward a small opening at its forward end, and having at least one groove formed in its tapered external surface for the passage of air over the forward end of the jet, an elongated needle having a tapered forward tip and a rearward end, means secured within said axial bore detachably engaging the rearward end of said needle for supporting the needle in fixed relationship with respect to said body, said needle being of a length that its tip extends through and closes the small opening in said jet when said air cap is at said rearwardmost position and is withdrawn from the small opening in response to longitudinal adjustment of said air cap forwardly from said rearwardmost position, and finger-operated valve means disposed within said depending tubular portion operable between a normally closed position and an open position for allowing air from a source of air under pressure to enter said axial bore when operated to its open position.

2. Airbrush according to claim 1, wherein the axial bore in the cylindrical forward portion of said body extends from said depending tubular portion to the forward end of said forward portion, and wherein said means for detachably engaging the rearward end of said needle is a unitary elongated carrier member supported within said axial bore, a forward portion of which being of tubular shape having an outer diameter smaller than the diameter of said axial bore and with said axial bore defining a passage for air, and having an inner bore defining a passage for paint and through which said needle extends and projects from the forward end thereof, and wherein the outer surface of the forward end of the forward portion of said carrier member is sealed to the internal surface of said jet.

3. Airbrush according to claim 2, wherein the cylindrical forward portion of said body has an opening through the wall thereof at a position to be surrounded by said depending threaded cap for the passage of paint from a jar secured to said threaded cap, and wherein the tubular portion of said carrier member has a cavity formed therein at the rearward end of its internal bore having an open side communicating with said opening.

4. Airbrush according to claim 3, wherein said needle is crimped at its rearward end and is sufficiently flexible to be detachably secured in said cavity.

5. Airbrush according to claim 4, wherein said carrier member is shaped to provide an air-to-paint seal between the perimeter of the open side of said cavity and the wall of said axial bore, and to define a passage for air to flow from said valve means to the passage for air defined by said axial bore and the outer surface of the tubular portion of said carrier member.

6. Airbrush according to claim 5, wherein said carrier member includes an elongated tang extending rearwardly through said axial bore from the portion thereof containing said cavity and at its rearward end engaging said finger-operated valve means for fixing the rotational position of said valve means with respect to said depending tubular portion.

7. Airbrush according to claim 6, wherein said valve means includes a stem sealably supported within the bore in said depending tubular portion and a ball adapted to seal the lower end of said bore when air under pressure is applied thereto, said stem being movable between a normally closed position to an open position at which the stem displaces said ball from its sealing relationship with the lower end of said bore for allowing air to enter said axial bore, and wherein said stem has a longitudinal slot formed in the surface thereof for receiving the rearward end of said tang.

8. Airbrush according to claim 2, wherein said body, said jet, and said carrier member are all fabricated from plastic material.

9. Airbrush according to claim 1, wherein the rearward portion of said body is essentially hollow and of approximately the same length as said cylindrical forward portion.

* * * * *